US005695350A

United States Patent [19]

Mei

[11] Patent Number: 5,695,350

[45] Date of Patent: Dec. 9, 1997

[54] EXTENSION SOCKET

[76] Inventor: Tzeng Jeng Nian Mei, No. 301, Shan-Shian Rd., Shan-Pin Village, Shan-Lin Hsiang, Kaohsiung Hsien, Taiwan

[21] Appl. No.: 674,739

[22] Filed: Jul. 2, 1996

[51] Int. Cl.[6] ..... H01R 13/44

[52] U.S. Cl. ..... 439/139; 439/143

[58] Field of Search ..... 439/137, 138, 439/139, 140, 143

[56] References Cited

U.S. PATENT DOCUMENTS

| | | | |
|---|---|---|---|
| 4,195,290 | 3/1980 | Magil et al. | 439/139 OR |
| 4,395,082 | 7/1983 | Rumble | 439/139 OR |
| 5,066,238 | 11/1991 | Shieh | 439/139 OR |
| 5,096,432 | 3/1992 | Cullen et al. | 439/139 OR |

*Primary Examiner*—P. Austin Bradley
*Assistant Examiner*—Daniel Wittels
*Attorney, Agent, or Firm*—Morton J. Rosenberg; David I. Klein; Jun Y. Lee

[57] ABSTRACT

The present invention provides an extension socket with guard plate frame, which comprises a basic stand, guard plates, springs, conducting strips, an upper shell and a lower shell. The feature of the present invention is to employ a guard plate sleeved on a shaft tube of the basic stand standing with a spring and controlled by two opposite beveled guide slots on the upper portion of the shaft tube of the basic stand and a couple of opposite projections in the inner wall of the tube portion of the guard plate fitting in the beveled guide slots. As a plug plugs in, the guard plate can be pivoted in an angle to turn away from the plug hole, further to act as safety and guard effect.

2 Claims, 3 Drawing Sheets

EXTENSION SOCKET

BACKGROUND OF THE INVENTION

The present invention relates to an extension socket, and more particularly to an extension socket with guard plate constructions.

Owing to the new techonology development and mass production, many of the electronic appliances are increasing in each family rapidly. Under this case, the wall outlets mounted within the house can no longer meet the need, and requires extension sockets as subsititude.

So far in the market the conventional extension sockets are consisted of two conducting strips connecting with extension cord mounted on the conducting strip holders in the lower shell and covered and fastened by an upper shell which has two rows of parallel plug holes. In practice, this extension socket is convenient to the needs of most customers and can solve the problem occurred by too short of the cord of some electrical equipment. But as we understand, this kind of extension socket is in an "open" status design which keeps the conducting strips uncovered to the outside through the plug holes. As we know this kind of "open" socket is danger in particular to the children, and more due to the conducting strips open to the air through the plug holes the dust may be collected in the socket to cause bad conducting.

OBJECTS OF THE INVENTION

In accordance with above-mentioned shortcomings of the conventional extension socket, a main object of the present invention is to provide an extension socket in that the plug holes are covered in a normal and unused state by guard plates and are opened automatically while a plug is plugged in.

The present invention comprises a basic stand, guard plates, springs, conducting strips, upper and lower shells. The basic stand includes several shaft tubes extending vertically in which there are two opposite beveled guide slots being formed on the top side. Each guard plate has a tube portion at the bottom side in that two opposite projections on the inside wall being formed. In combining, the springs and guard plates are sleeved on the shaft tubes respectively and the projections of the guard plates slide into the beveled guide slots of the shaft tubes for turning the guard plate as the plug plugs in to press down the guard plate.

It is another object of the present invention to provide an extension socket which prevents children from inserting their fingers into the plugs and get electric shot.

It is a further object of the present invention to provide an extension socket which provides a better connection design.

DESCRIPTION OF THE PREFERRED EMBODIMENT

Figure 1:
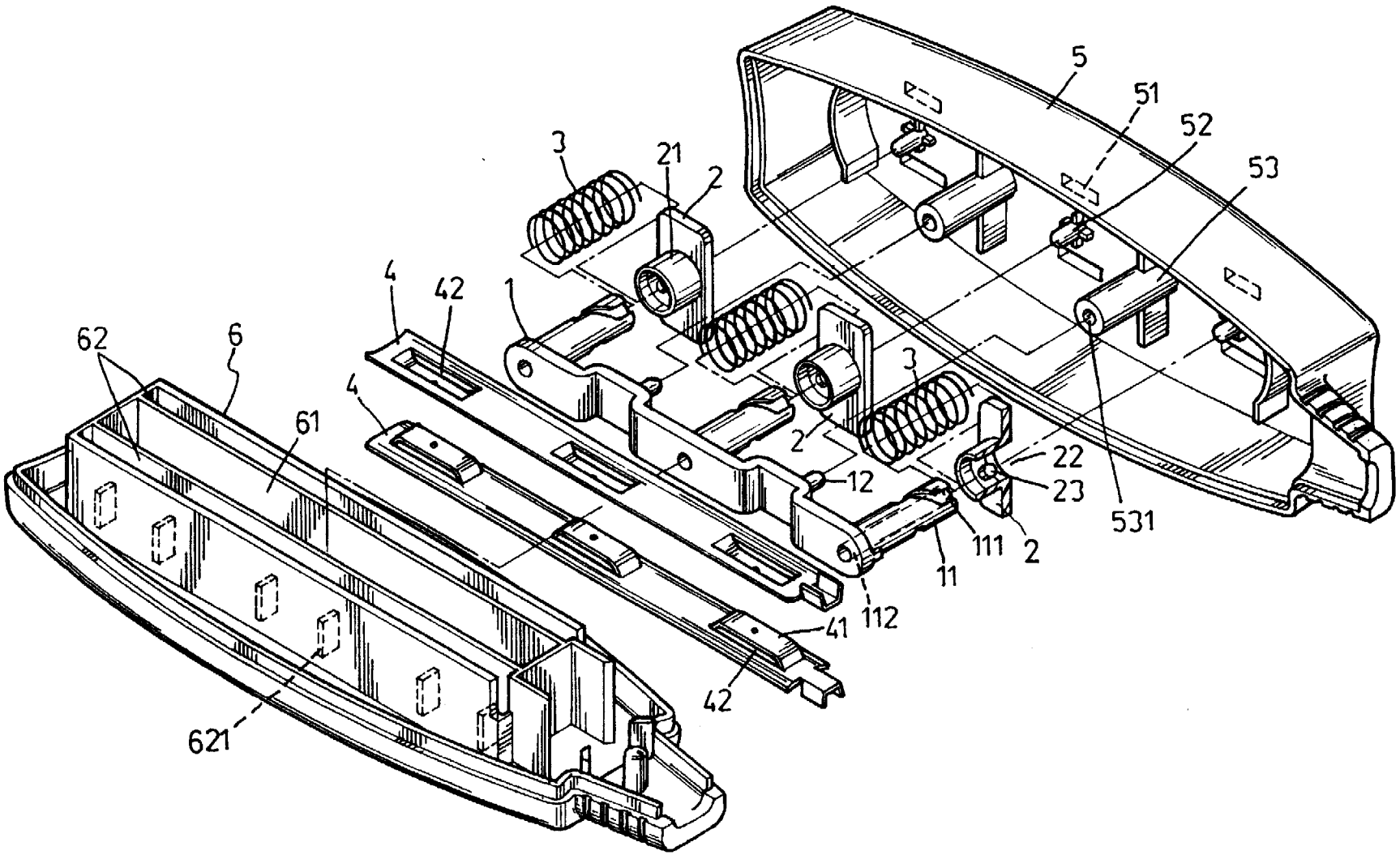
FIG. 1 is an exploded view of the present invention.

As shown in FIG. 1, the present invention comprises a basic stand 1, guard plates 2, springs 3, conducting strips 4, an upper shell 5 and a lower shell 6 corresponding both in size and shape to the upper shell.

The basic stand 1 is a staged, wave-shaped strip stand having a plurality of shaft tubes 11 with through-hole 112 extending upwardly from a projecting surface, two opposite beveled guide slots 111 being formed on the top portion of the shaft tubes 11, and a pin 12 extending from the lower surface inbetween the adjacent shaft tubes 11.

The guard plate 2 is a rectangular plate in that a tube portion 21 with a through-hole 22 is extending from the center portion of the bottom side and two projections 23 extending from the inner wall of the tube portion 21 opposing each other.

The springs 3 are sleeved onto the shaft tubes 11 of the basic stand 1, respectively.

The conducting strip 4 is a slender strip having a plurality of protruding surfaces 41 forming a gap 42 with respect of the surface of the strip for insertion of the plug therein.

The upper shell 5 has two rows of paralleled plug holes 51, three humps 52 protruding from the inside thereof and two setting poles 53 integrally formed between the humps 52 and corresponding to the pins 12 of the basic stand 1. Each pole 53 has a blind setting hole 531 at the top end.

The lower shell 6 has a corresponding shape and size with respect to the upper shell 5, a basic stand housing 61 at the inner center portion and two conducting strip holders 62 protruding some stripes 621 at the respective sides of the basic stand housing 61 for holding the conducting strips 4 thereat.

Figure 2:
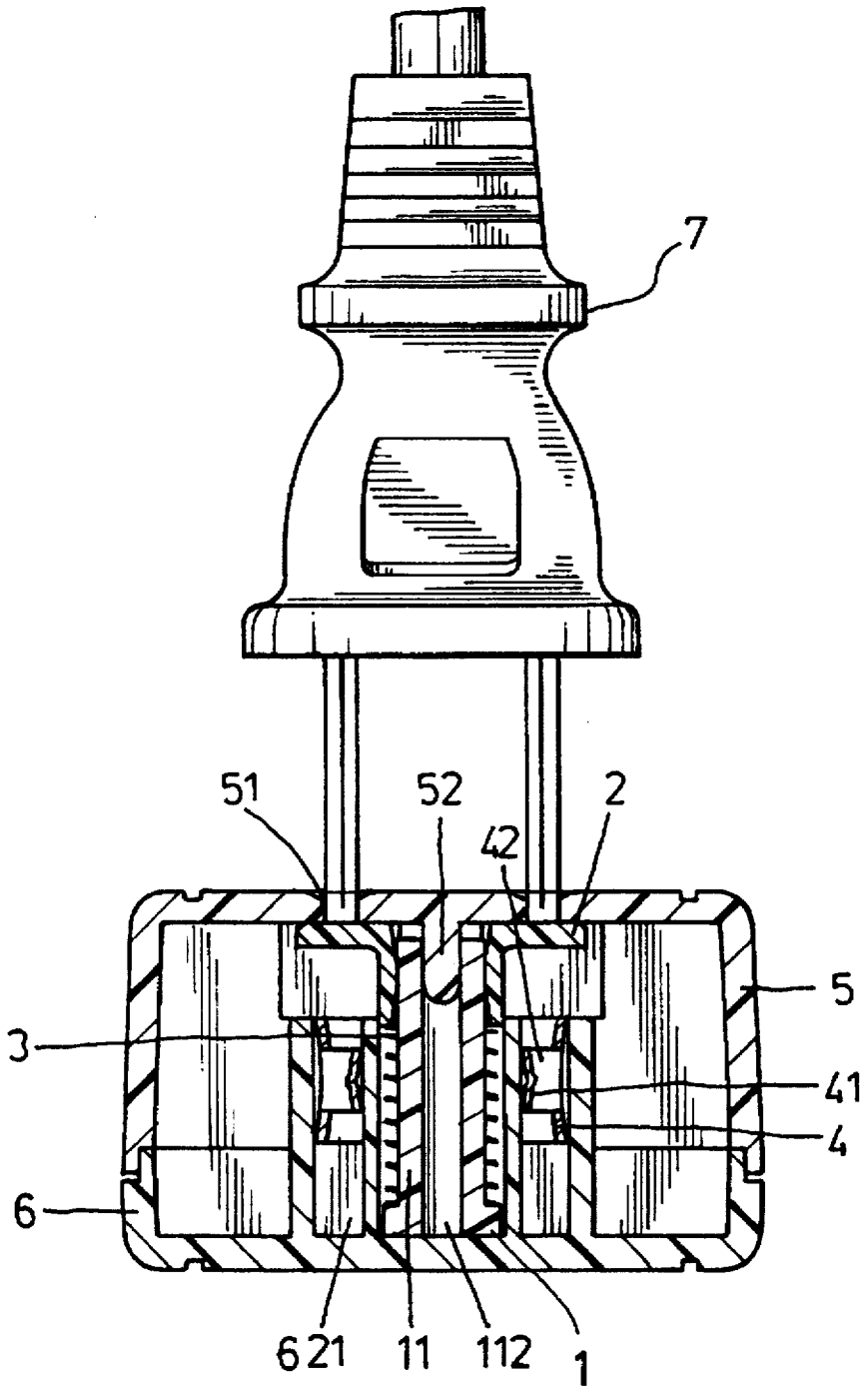
FIG. 2 is a cross-section view of the present invention.

In assembling, referring to FIG. 2, the basic stand 1 is placed in the basic stand housing 61 of the lower shell 6, the springs 3 sleeve over the shaft tubes 11 of the basic stand 1, the guard plates 2 cover on the top end of the shaft tubes 11 to ensure the projections 23 of the guard plates 2 fitting into the beveled guide slots 111 of the shaft tubes 11. Next, insert the conducting strips 4 into the lower shell 6 and connecting with the extension cord into the conducting strip holders 62. Lastly, cover the lower shell 6 with the upper shell 5 with the blind setting holes 531 on the top portion of the setting poles 53 of the upper shell 5 link with the pins 12 on the basic stand 1 and the through-holes 112 on the shaft tubes 11 of the basic stand 1 link with the humps 52 of the up shell 5, and the springs 3 standing on the basic stand 1 urging the guard plates 2 to close the plug holes 51 of the up shell 5.

Figure 3:
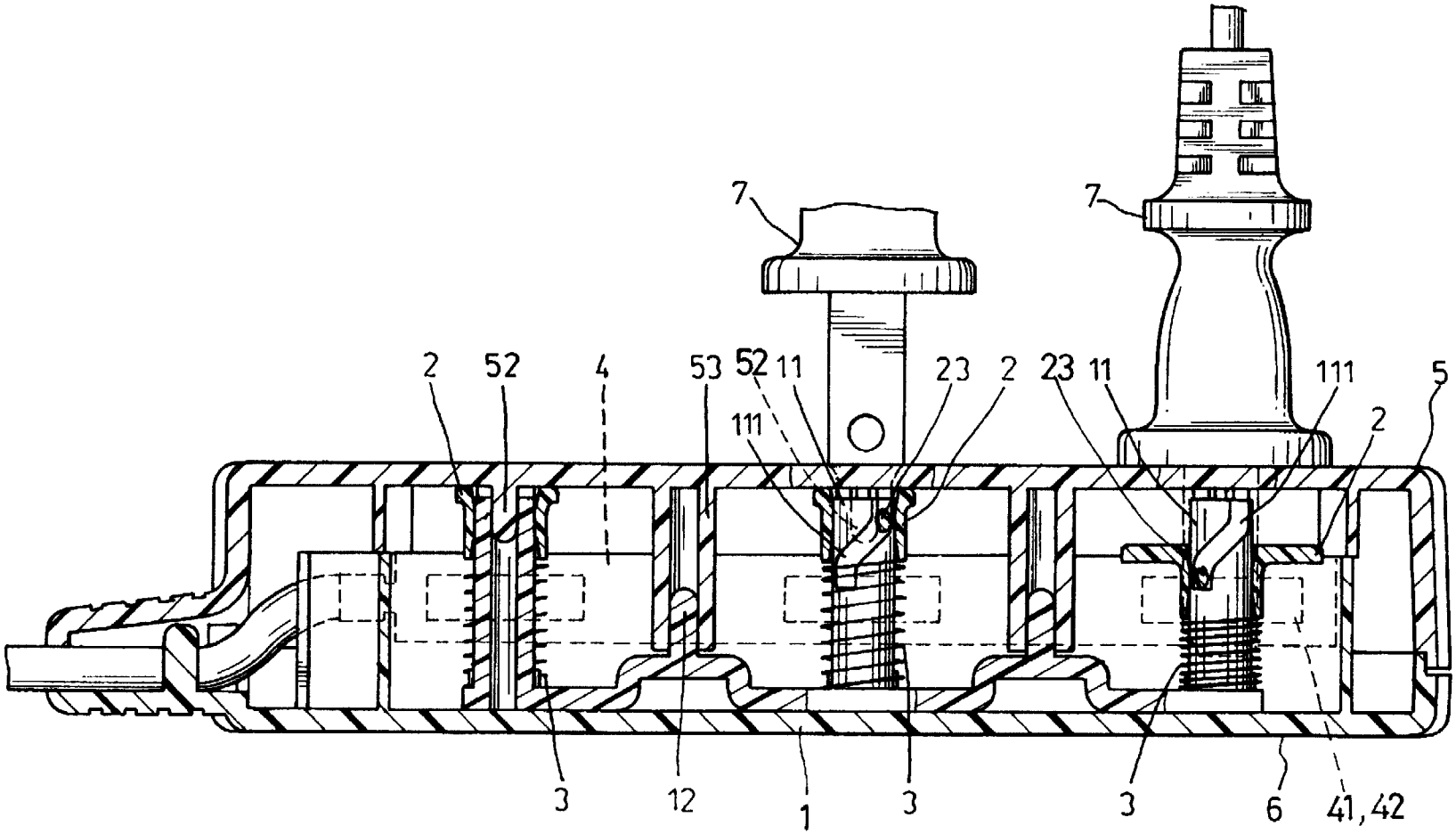
FIG. 3 is a cross-section view demonstrating a plug being inserted into an extension socket of the present invention.

In practicing, as shown of FIG. 3, a plug 7 plugs into the plug holes 51 on the upper shell 5 in an ordinary manner, the guard plate 2 is pressed down to urge the spring 3 by the plug-in strip of the plug 7, meanwhile the projections 23 on the inside wall of the tube portion 21 slide down along the beveled guide slots 111 on the upper of the shaft tube 11 to lead the guard plate 2 turning in an angle to pivot away from the plug holes 51 for the plug plugging in to make contact with the conducting strips 4 in the gaps 42. When pulling out the plug 7 from the plug hole 51 on the upper shell 5, the guard plate 2 is urged again by the restoring force of the spring 3, the projections 23 of the guard plate 2 slide up along the beveled guide slots 111 on the upper of the shaft tube 11 to turn in an angle to pivot on the plug holes 51 for keeping the holes in sealing state.

On the other hand, if only one plug hole 51 is pressed by an extra force, due to an unbalancing force effecting on the guard plate 2, one projection 23 is blocked by the beveled guide slot 111 of the shaft tube 11 of the basic stand 1 which prevents the guard plate 2 from pivoting in a normal manner and therefore the plug hole 51 is kept in a blocked state.

I claim:

1. An extension socket comprising a basic stand, guard plates, springs, conducting strips, an upper shell having a series of parallel plug holes and a series of conducting strips corresponding to a lower shell, the improvements comprising:

said basic stand having at least one shaft tube with two opposite beveled guide slots on a upper end; each of said guard plates having a hollow tube portion built on a center portion of a bottom side, and two opposite projections on a inner side wall of said tube portion; said basic stand being placed into the basic stand housing of said lower shell, with springs sleeved on said shaft tube of said basic stand and said guard plates, thus urging said guard plates against the inner wall of said plug holes, furthermore, said projections of said guard plate fitting in beveled guide slots on said shaft tube of said basic stand.

2. An extension socket as claimed in claim 1, wherein, each said conducting strip having at least an protruding surface for forming a gap with respect to a surface of said conducting strip for receiving a blade of an electrical plug therein.

* * * * *